United States Patent [19]

Warp

[11] Patent Number: 4,947,999

[45] Date of Patent: Aug. 14, 1990

[54] LINER STRUCTURE FOR SHELVES, DRAWERS, AND THE LIKE

[76] Inventor: Harold G. Warp, 1100 N. Cicero Ave., Chicago, Ill. 60651

[21] Appl. No.: 299,393

[22] Filed: Jan. 23, 1989

[51] Int. Cl.[5] ..... A47F 5/00

[52] U.S. Cl. ..... 211/183; 211/134; 108/901

[58] Field of Search ..... 211/59.2, 183, 90, 135, 211/73, 134; 108/901

[56] References Cited

U.S. PATENT DOCUMENTS

| | | | |
|---|---|---|---|
| 3,454,168 | 7/1969 | Cahn | 211/74 X |
| 3,861,326 | 1/1975 | Brown | 108/901 X |
| 4,189,125 | 2/1980 | Little | 108/901 X |
| 4,461,388 | 7/1984 | Bustos | 211/59.2 |
| 4,496,037 | 1/1985 | Spamer | 211/153 X |
| 4,519,508 | 5/1985 | Gullett et al. | 211/59.2 |
| 4,565,725 | 1/1986 | Spamer et al. | 211/59.2 X |

*Primary Examiner*—Robert W. Gibson, Jr.
*Attorney, Agent, or Firm*—Wood, Phillips, Mason, Recktenwald & VanSanten

[57] ABSTRACT

A liner structure is provided for covering shelves, drawer bottoms and the like. The structure includes a sheet of flexible plastic material having a substantially flat bottom side for lying on a subjacent surface of a shelf or drawer. An integral raised pattern of ridges project upwardly from a top side of the sheet. The tops of the ridges are generally coplanar and provide a reduced surface area for supporting appropriate articles and for allowing air flow beneath the articles.

13 Claims, 1 Drawing Sheet

LINER STRUCTURE FOR SHELVES, DRAWERS, AND THE LIKE

FIELD OF THE INVENTION

This invention generally relates to an article support structure and, particularly, to a liner structure for covering shelf, drawer and like support surfaces.

BACKGROUND OF THE INVENTION

Liner sheets are used in a majority of households for covering a wide variety of article support surfaces, such as shelves, drawer bottoms, pantry floors and the like. The liners are used to protect surfaces, to facilitate cleaning and to provide a replaceable surface covering means. Most often, liner material comes in roll form and is cut to size for fitting on top of a given support surface. Most liner material is extremely thin and quite difficult to handle.

There are various problems inherent in using presently available liner material. For instance, most liner material is fabricated of coated paper or very thin plastic sheet material which provides a smooth supporting surface. When dishes, glassware and other such articles are placed on the liner material, there is no way for the escape of moisture from beneath the articles, sometimes causing the formation of mildew. This may result simply from humid conditions or from residue moisture after washing the articles. The moisture also causes the articles to stick to the liner material.

In addition, heavy plates, pots, pans and the like cannot slide easily over the smooth liner surface, often causing scratching or tearing of the liner material. The thin material also has a tendency to buckle, bend or tear during use, or even during installation.

The end result is that individuals often resort to more durable substitutes, even to the extent of cutting pieces from ordinary floor linoleum materials which, to say the least, are not very aesthetically pleasing.

This invention is directed to solving the above problems and satisfying the need for an improved liner structure of the character described.

SUMMARY OF THE INVENTION

An object, therefore, of the invention is to provide a new and improved liner structure for shelves, drawers, and the like.

In the exemplary embodiments of the invention, a sheet of flexible material is provided with a substantially flat bottom side for lying on a subjacent surface of a shelf, drawer or the like. The sheet may be an extrusion of plastic material. An integral raised pattern is provided on a top side of the sheet to provide a reduced surface area for supporting appropriate articles and for allowing air flow beneath the articles.

More particularly, the sheet of flexible material is formed of a web of generally uniform thickness, such as on the order of 0.015–0.020 inch thick, with the raised pattern projecting upwardly from the web. The raised pattern may project approximately 0.020 inch above the top surface of the web.

As disclosed herein, the raised pattern for supporting the articles defines a generally planar array of ridges, but spaced detents or "bumps" are contemplated The ridges may be generally parallel and, if so, the sheet material can be fabricated in roll form having a long dimension and a short dimension, with the ridges extending generally parallel or perpendicular to the long dimension. The ridges may be in other patterns, such as a diamond pattern of intersecting ridges, a square pattern of intersecting ridges, or a plurality of arcuate or circular ridges. The top edges of the ridges may be pointed or rounded.

By fabricating the liner sheet structure of plastic material, the unitary web and ridges may be clear to allow an underlying pattern or light to show through. It may be fabricated of translucent material to allow light to pass through in a diffused manner. On the other hand, it may be fabricated of colored or printed material, all in flat or rolled form.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
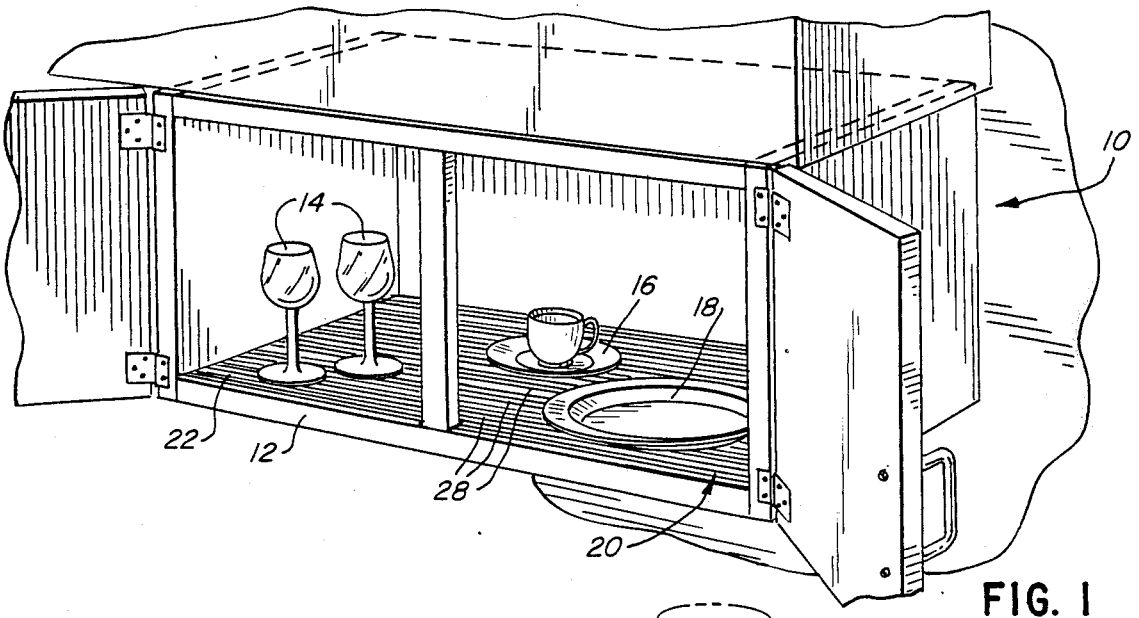
FIG. 1 is a somewhat schematic perspective view of a shelf assembly, with a liner structure being used therewith and incorporating the concepts of the invention.

Referring to the drawings in greater detail, and first to FIG. 1, a shelf structure, generally designated 10, is shown to include a bottom wall or floor 12 on which articles can be placed, such as glassware 14, cups and saucers 16, and plates 18. A liner structure, generally designated 20, embodying the concepts of the invention, is shown cut to fit on top of bottom wall 12 of shelf structure 10 for supporting the household articles.

The liner structure of this invention has a wide range of applications, as will be understood hereinafter. However, at this point, it should be understood that shelf structure 10 is shown for exemplary purposes only. The liner structure of this invention can be used to cover the bottoms of drawers, the floors of pantries, the tops of bars or counters, and any other similar applications where the advantages of the invention can be realized.

Figure 2:
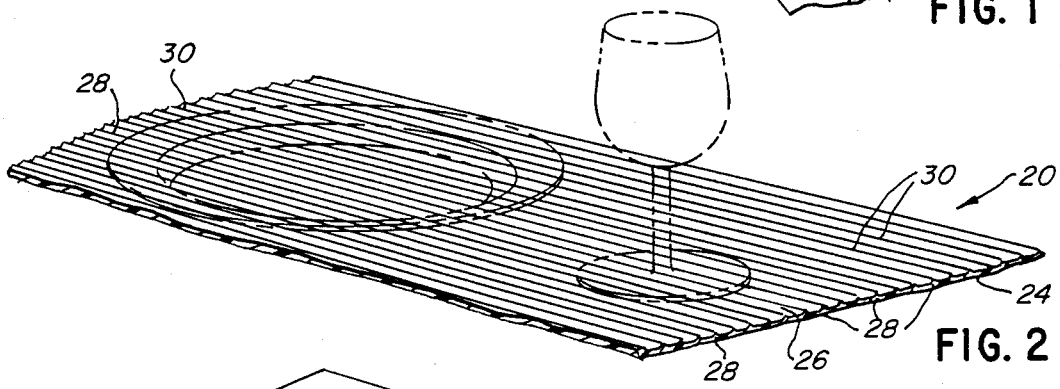
FIG. 2 is a fragmented section through a liner structure of the invention, showing a raised pattern of generally parallel ridges.

Generally, liner structure 20 is designed of flexible or semi-rigid sheet material with a raised pattern on the top surface thereof for supporting appropriate articles. More particularly, FIG. 2 shows liner structure 20 to include a flat web 22 of generally uniform thickness and having a substantially flat bottom side 24 for lying on a subjacent surface, such as bottom wall 12 of shelf structure 10 in FIG. 1. Web 22 has a substantially flat top side 26. In order to provide a semi-rigid structure which is sufficiently flexible for manipulation during installation, liner structure 20 is fabricated of plastic material, such as polyethylene or vinyl, with web 22 being on the order of 0.015–0.020 inch thick.

The invention contemplates providing liner structure 20 with a unitary raised pattern projecting upwardly from top side 26 of web 22 and which actually forms the support surfaces for the articles, such as articles 14–18 in FIG. 1. As shown in FIG. 2, the raised pattern is defined by a plurality of generally parallel ridges 28 defining top edges 30. The top edges may be pointed, as shown, or rounded or flat if desired A flat top edge is not preferred as it restricts air circulation. The top edges of the ridges are coplanar to provide an effective flat supporting "surface" or means. With web 22 being on the order of 0.015–0.020 inch thick, ridges 28 may be on the order of 0.020 inch high and approximately the same dimension in width at the base of the ridges. The ridges also should be spaced sufficiently close to each other, such as on the order of 0.20 inch apart, to provide the effective supporting "surface" without allowing any ordinary household items, such as stemmed glassware, from tilting and falling over.

Figure 3:
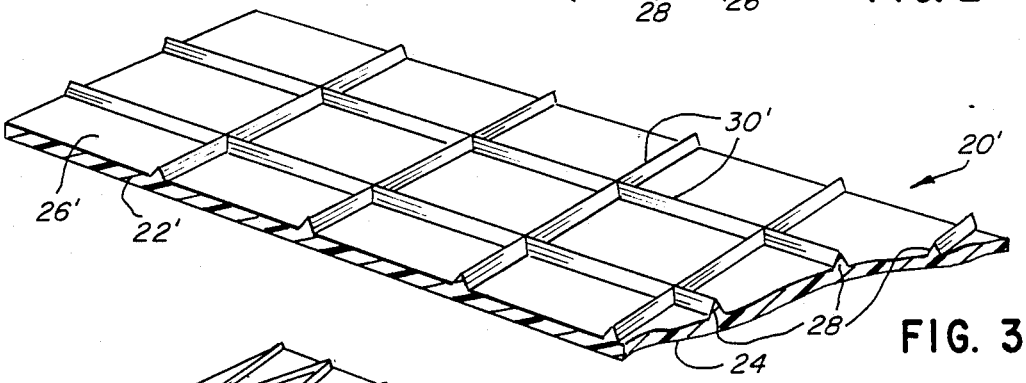
FIG. 3 is a view similar to that of FIG. 2, showing a raised "square" pattern of intersecting ridges.

FIG. 3 shows an alternate embodiment of the invention wherein a liner structure, generally designated 20', is fabricated with a web 22' and a "square" pattern of intersecting ridges 28' having top edges 30'. The thickness of the web, and the dimensions and spacing of the ridges in FIG. 3 may be the same as that described in relation to liner structure 20 in FIG. 2. Again, the top edges 30' of ridges 28' combine to provide an effective planar supporting "surface" for the supported articles.

Figure 4:
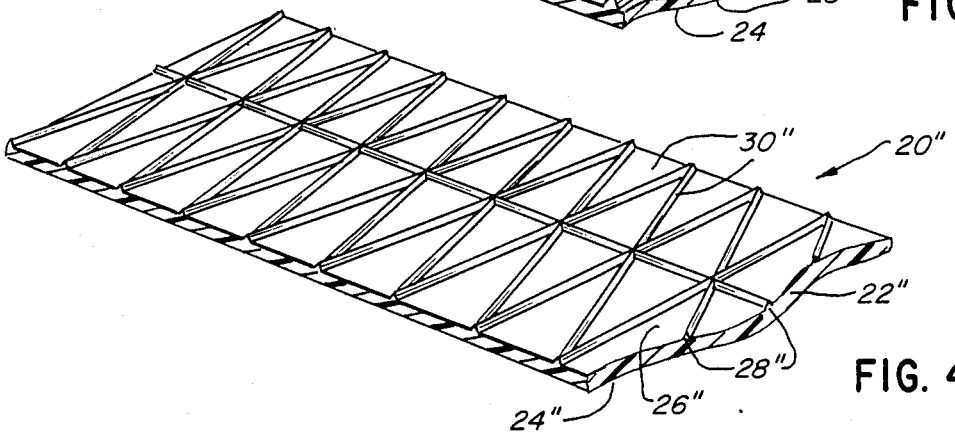
FIG. 4 is a view similar to that of FIGS. 2 and 3, showing a raised "diamond" pattern of intersecting ridges.

FIG. 4 shows a further embodiment of the invention wherein a liner structure, generally designated 20", includes a web 22" and a raised "triangular" pattern of intersecting ridges 28" having top edges 30". The thickness of web 22" and the dimensions and spacing of ridges 28" may be the same as that described in relation to liner structure 20 in FIG. 2. Again, the top edges 30" of intersecting ridges 28" combine to provide an effective supporting "surface" for appropriate articles In either embodiment of FIGS. 3 or 4, the top edges of the ridges can be pointed, as shown, or rounded if desired.

With the description of liner structures 20, 20', and 20" in FIGS. 2, 3, and 4, respectively, it can be understood that other raised patterns are contemplated by the invention. For instance, a pattern of appropriately spaced, closed circular ridges could be used. A pattern of appropriately spaced raised detents or "bumps" also could combine to provide an effective raised supporting "surface" for appropriate articles In fabricating any of the liner structures contemplated by the invention, the liner can be manufactured as a unitary sheet extrusion of plastic material with the web and ridges simultaneously formed. Of course, the web could be extruded, with the ridges formed by hot rolling. The material of the liner structure could be clear to allow an underlying pattern or light to show therethrough. On the other hand, the liner may be textured or fabricated of translucent plastic material to allow light to pass therethrough in a diffused manner. The material could be colored or printed for decor coordinating purposes In packaging, the liner material could be in either flat or rolled form.

The liner structure of this invention has a number of advantages. First, the unitary raised pattern on top of the web provides a reduced surface area for supporting the appropriate articles. This reduced surface area allows for plates, pots, pans and the like to slide in and out of a shelf or drawer, with ease as compared to a flat surface, resulting in a substantially friction-free structure, particularly when using plastic material In addition, the raised pattern of ridges allow for air to flow beneath the articles to aerate the articles to allow them to dry when damp, to clear out moisture during humid conditions and simply to clear out stale air. Further, the raised pattern prevents the articles from scratching the top surface of web 22 to maintain its original properties and to facilitate cleaning. Heavier articles, such as pots or pans, will not abrade the web, providing durability and eliminating scoring which could tear the liner The raised pattern also helps to stiffen the web to maintain the web in flat condition on a subjacent surface and prevent buckling and bending when articles are moved over the liner, which is a considerable problem with prior liner sheet material Lastly, it is desirable to provide for replaceability of any liner material Heretofore, with the thin sheet liner material which is predominant in the marketplace, the material either must be laid onto a shelf in free condition which results in shifting, bending and buckling of the material, or the liner is secured in place by adhesives or tape which either causes tearing during use or during removal. With the semi-rigid construction of the drawer liner of this invention, such securing means as double-faced tape can be used at the periphery of a liner section, and the liner section easily can be removed from the tape or adhesive without tearing.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

I claim:

1. In combination:

a shelf having a flat, horizontally disposed, upwardly facing, surface for the placement of articles to be stored/displayed in a free standing position; and a liner structure comprising a sheet of flexible material having a web with a substantially flat bottom side facially engaging the flat shelf support surface and means extending upwardly from said web and defining an integral raised pattern on a top side of the web to provide a reduced substantially horizontal surface area for supporting articles in a free standing position and for allowing air flow beneath the articles supported on said sheet top side, whereby said web and means defining said raised pattern cooperatively define a collection area for any moisture from articles supported on said liner structure and, by reason of the horizontal situation of said liner on said shelf, any water collected spreads out substantially evenly in said collection area to avoid contact with articles supported on the liner.

2. A shelf and drawer liner structure for a substantially flat horizontally disposed surface on a shelf, drawer, and the like, said liner structure comprising a sheet of flexible material having a substantially flat bottom side for lying facially against the flat horizontally disposed surface of a shelf, drawer and the like, and means defining an integral raised pattern on a top side of the sheet to provide a reduced substantially horizontal surface area for supporting appropriate articles and for allowing flow beneath the articles supported on said sheet top side, wherein said liner structure is fabricated from a translucent material to allow light to be projected through said liner structure.

3. The shelf and drawer liner structure of claim 1 wherein said sheet comprises a web of generally uniform thickness and defining said bottom side with the raised pattern projecting upwardly from said web.

4. The shelf and drawer liner structure of claim 3 wherein said web is on the order of 0.015–0.020 inch thick.

5. The shelf and drawer liner structure of claim 4 wherein said raised pattern projects approximately 0.020 above the web.

6. The shelf and drawer liner structure of claim 1 wherein said raised pattern defines a generally planar array of ridges.

7. The shelf and drawer liner structure of claim 6 wherein said ridges are generally parallel.

8. The shelf and drawer liner structure of claim 7 wherein said sheet has a long dimension and a short dimension and said ridges extend generally parallel to the long dimension.

9. The shelf and drawer liner structure of claim 7 wherein said sheet has a long dimension and a short dimension and said ridges extend generally perpendicular to the long dimension.

10. The shelf and drawer liner structure of claim 6 wherein said ridges are in a diamond pattern.

11. The shelf and drawer liner structure of claim 6 wherein said ridges are in a square pattern.

12. The shelf and drawer liner structure of claim 76 wherein said flexible sheet has a web with said ridges integrally formed therewith, said ridges having pointed top edges, and each said ridge has opposite surfaces converging from said web to said pointed top edge.

13. The shelf and drawer liner structure of claim 6 wherein said ridges have rounded top edges.

* * * * *